US006348868B1

(12) United States Patent
Chou

(10) Patent No.: US 6,348,868 B1
(45) Date of Patent: Feb. 19, 2002

(54) FAULT ALARM FOR ABNORMAL TEMPERATURE DETECTION

(76) Inventor: Ching-Lung Chou, 58, Ma Yuan West St., Taichung (TW)

( * ) Notice: Subject to any disclaimer, the term of this patent is extended or adjusted under 35 U.S.C. 154(b) by 0 days.

(21) Appl. No.: 09/546,148

(22) Filed: Apr. 5, 2000

(51) Int. Cl.[7] ..... G08B 17/00

(52) U.S. Cl. ..... 340/584; 340/506; 340/511; 340/581

(58) Field of Search ..... 340/506, 511, 340/514, 577, 581, 584, 588, 589

(56) References Cited

U.S. PATENT DOCUMENTS 6,060,991 A * 5/2000 Hsieh ..... 340/632
6,215,404 B1 * 4/2001 Morales ..... 340/577
6,215,405 B1 * 4/2001 Handley et al. ..... 340/584
6,252,505 B1 * 6/2001 Bade ..... 340/540
6,288,638 B1 * 9/2001 Tanguay et al. ..... 340/514

* cited by examiner

*Primary Examiner*—Daryl Pope

(57) ABSTRACT

A microcomputer is connected to a detect circuit for an out-of-phase electric source, a flow switch for a cooling liquid, a refrigerant high pressure switch, a refrigerant low pressure switch, a pump overload protector, a compressor overload protector, an abnormal detect circuit for an oil temperature sensor, an abnormal detect circuit for a room temperature sensor, an abnormal detect circuit for a temperature detection, a timing circuit for an air filter net, a timing circuit for a cooling liquid filter, and a voice electric circuit electrically

3 Claims, 1 Drawing Sheet

FAULT ALARM FOR ABNORMAL TEMPERATURE DETECTION

BACKGROUND OF THE INVENTION

The invention relates to a fault alarm for abnormal temperature detection. More particularly, the invention relates to a fault alarm which will alarm while an abnormal temperature is detected.

An alarm will alarm a user that an operation system is in an abnormal condition. However, the user should check the whole operation system in order to find where a fault occurs.

SUMMARY OF THE INVENTION

An object of the invention is to provide a fault alarm for abnormal temperature detection in order to alarm a user while an abnormal temperature is detected.

Another object of the invention is to provide a fault alarm for abnormal temperature detection in order to produce a voice alarm while an abnormal temperature is detected.

Accordingly, a fault alarm for abnormal temperature detection comprises a detect circuit for an out-of-phase electric source, a flow switch for a cooling liquid, a refrigerant high pressure switch, a refrigerant low pressure switch, a pump overload protector, a compressor overload protector, an abnormal detect circuit for an oil temperature sensor, an abnormal detect circuit for a room temperature sensor, an abnormal detect circuit for a temperature detection, a timing circuit for an air filter net, a timing circuit for a cooling liquid filter, a microcomputer, a voice electric circuit, a language select switch, and a loudspeaker. The microcomputer is connected to the detect circuit for the out-of-phase electric source, the flow switch for the cooling liquid, the refrigerant high pressure switch, the refrigerant low pressure switch, the pump overload protector, the compressor overload protector, the abnormal detect circuit for the oil temperature sensor, the abnormal detect circuit for the room temperature sensor, the abnormal detect circuit for the temperature detection, the timing circuit for the air filter net, the timing circuit for the cooling liquid filter, and the voice electric circuit electrically. The voice electric circuit is connected to the loudspeaker and the language select switch electrically.

DETAILED DESCRIPTION OF THE INVENTION

Figure 1:
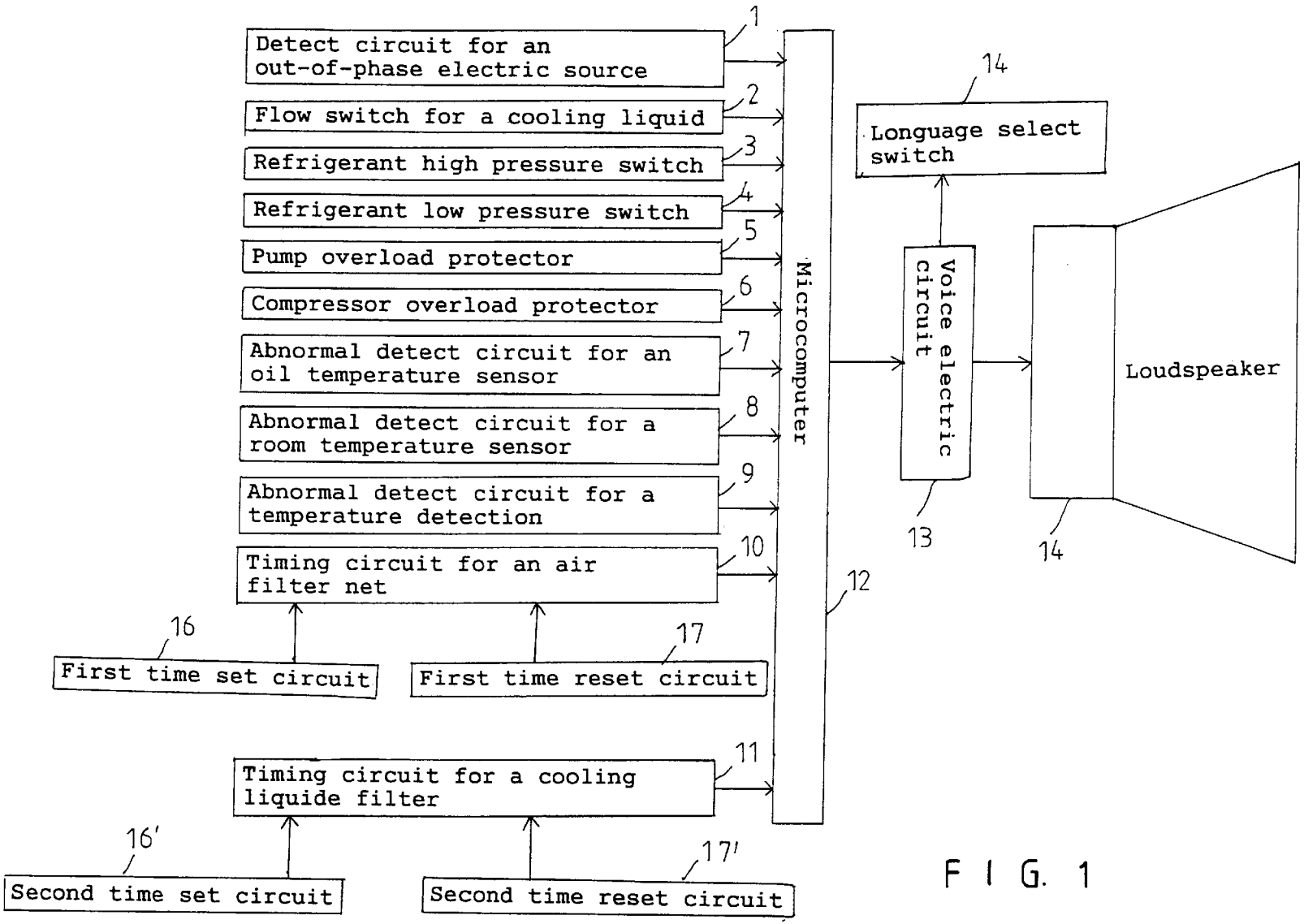
FIG. 1 is a block diagram of a fault alarm for abnormal temperature detection of a preferred embodiment in accordance with the invention.

Referring to FIG. 1, a fault alarm for abnormal temperature detection comprises a detect circuit for an out-of-phase electric source 1, a flow switch for a cooling liquid 2, a refrigerant high pressure switch 3, a refrigerant low pressure switch 4, a pump overload protector 5, a compressor overload protector 6, an abnormal detect circuit for an oil temperature sensor 7, an abnormal detect circuit for a room temperature sensor 8, an abnormal detect circuit for a temperature detection 9, a timing circuit for an air filter net 10, a timing circuit for a cooling liquid filter 11, a microcomputer 12, a voice electric circuit 13, a language select switch 14, and a loudspeaker 15.

The microcomputer 12 is connected to the detect circuit for the out-of-phase electric source 1, the flow switch for the cooling liquid 2, the refrigerant high pressure switch 3, the refrigerant low pressure switch 4, the pump overload protector 5, the compressor overload protector 6, the abnormal detect circuit for the oil temperature sensor 7, the abnormal detect circuit for the room temperature sensor 8, the abnormal detect circuit for the temperature detection 9, the timing circuit for the air filter net 10, the timing circuit for the cooling liquid filter 11, and the voice electric circuit 13 electrically.

The voice electric circuit 13 is connected to the loudspeaker 15 and the language select switch 14 electrically.

A first time set circuit 16 and a first time reset circuit 17 are connected to the air filter net 10.

A second time set circuit 16' and a second time reset circuit 17' are connected to the cooling liquid filter 11.

The flow switch for the cooling liquid 2 controls the flowing amount of the cooling liquid.

The user can select a language by switching the language select switch 14.

The fault alarm for abnormal temperature detection will send a voice alarm via the loudspeaker 15 while an abnormal temperature is detected.

The invention is not limited to the above embodiment but various modification thereof may be made. Further, various changes in form and detail may be made without departing from the scope of the invention.

I claim:

1. A fault alarm for abnormal temperature detection comprises:

a detect circuit for an out-of-phase electric source, a flow switch for a cooling liquid, a refrigerant high pressure switch, a refrigerant low pressure switch, a pump overload protector, a compressor overload protector, an abnormal detect circuit for an oil temperature sensor, an abnormal detect circuit for a room temperature sensor, an abnormal detect circuit for a temperature detection, a timing circuit for an air filter net, a timing circuit for a cooling liquid filter, a microcomputer, a voice electric circuit, a language select switch, and a loudspeaker, the microcomputer connected to the detect circuit for the out-of-phase electric source, the flow switch for the cooling liquid, the refrigerant high pressure switch, the refrigerant low pressure switch, the pump overload protector, the compressor overload protector, the abnormal detect circuit for the oil temperature sensor, the abnormal detect circuit for the room temperature sensor, the abnormal detect circuit for the temperature detection, the timing circuit for the air filter net, the timing circuit for the cooling liquid filter, and the voice electric circuit electrically, and the voice electric circuit connected to the loud-speaker and the language select switch electrically.

2. A fault alarm for abnormal temperature detection as claimed in claim 1, wherein a first time set circuit and a first time reset circuit are connected to the air filter net.

3. A fault alarm for abnormal temperature detection as claimed in claim 2, wherein a second time set circuit and a second time reset circuit are connected to the cooling liquid filter.

* * * * *